US008518201B2

(12) United States Patent
Courtney et al.

(10) Patent No.: US 8,518,201 B2
(45) Date of Patent: Aug. 27, 2013

(54) METHOD OF MANUFACTURING A TUBING FOR A SUBSURFACE WATER DRAINAGE SYSTEM

(75) Inventors: William J. Courtney, Millstadt, IL (US); Andrew Chapman, St. Louis, MO (US)

(73) Assignee: Midwest Diversified Technologies, Inc., Belleville, IL (US)

( * ) Notice: Subject to any disclaimer, the term of this patent is extended or adjusted under 35 U.S.C. 154(b) by 453 days.

(21) Appl. No.: 12/799,162

(22) Filed: Apr. 20, 2010

(65) Prior Publication Data

US 2010/0272513 A1 Oct. 28, 2010

Related U.S. Application Data

(60) Provisional application No. 61/214,325, filed on Apr. 22, 2009.

(51) Int. Cl.
*E02B 11/00* (2006.01)
*B29D 22/00* (2006.01)

(52) U.S. Cl.
USPC ..... 156/201; 156/213; 405/45

(58) Field of Classification Search
None
See application file for complete search history.

(56) References Cited

U.S. PATENT DOCUMENTS

| | | | | |
|---|---|---|---|---|
| 4,246,305 | A * | 1/1981 | Delattre | 428/36.9 |
| 4,572,700 | A | 2/1986 | Mantarro | |
| 4,588,325 | A * | 5/1986 | Seefert | 405/46 |
| 4,793,728 | A | 12/1988 | Ellis | |
| 4,898,494 | A | 2/1990 | Ellis | |
| 4,995,759 | A * | 2/1991 | Plowman et al. | 405/43 |
| 5,017,040 | A * | 5/1991 | Mott | 405/36 |
| 5,246,516 | A * | 9/1993 | Rias | 156/202 |
| 6,951,592 | B2 * | 10/2005 | McConnell et al. | 156/211 |
| 8,002,942 | B2 * | 8/2011 | Horiguchi et al. | 156/292 |

FOREIGN PATENT DOCUMENTS

WO WO 2009022498 A1 * 2/2009

* cited by examiner

*Primary Examiner* — Barbara J. Musser
(74) *Attorney, Agent, or Firm* — Greensfelder, Hemker & Gale, P.C.

(57) ABSTRACT

A tubing with improved compression strength for a subsurface water drainage system comprising a core polymeric support structure wrapped longitudinally in first and second geotextile materials, wherein the core polymeric support structure is heated to soften the polymeric material and wherein the first and second geotextile materials overlap and are adhered together with a hot melt adhesive and tensioned to tightly wrap the core, thereby forming the tubing.

3 Claims, 2 Drawing Sheets

METHOD OF MANUFACTURING A TUBING FOR A SUBSURFACE WATER DRAINAGE SYSTEM

RELATED INVENTIONS

The present application claims the benefit of provisional application 61/214325, filed Apr. 22, 2009.

FIELD OF THE INVENTION

The present invention is directed to a system for water drainage, and more particularly to a subsurface system for draining water from beneath covered ground, such as the sub-base of a roadway. The system uses a tube made of a polymeric support structure core wrapped in a geotextile material.

BACKGROUND OF THE INVENTION

A major cause of damage to road surfaces is the entrapment or retention of water beneath the road surface, in the road base or sub-base. Such retained water can cause potholes, buckles and gaps in the pavement, as well as cracking or crumbling of the pavement, and can lead to premature collapse or failure of the roadbed. Rapid subsurface drainage of the roadbed is thus critical to extending the useful life of the highway.

The HYDRAWAY™ drain (a trade mark of Midwest Diversified Technologies, Inc.) is a known drainage system useful for this purpose. It comprises a tubular, internally supported geotextile fabric filter disposed in the ground beneath or preferably adjacent to a covered ground surface, for example, in the sub-base of a highway or pavement. The filter support is constructed of a somewhat rigid but resiliently deformable polyethylene core, about which the filter is circumferentially disposed, and to which the filter is bonded. This system is disclosed in U.S. Pat. Nos. 4,793,728 and 4,898,494. A disadvantage of the disclosed tubular filter is the polyethylene core, which provides inadequate support, and has poor compressive strength. The '494 patent discloses that the compressive strength of the core is about 5000 psf. This poor strength makes the tubular filter susceptible to collapse when buried, and susceptible to damage when transported and handled.

SUMMARY OF THE INVENTION

The present invention is a method of manufacturing a tubing for a subsurface water drainage system comprising a core polymeric support structure having a top surface and a bottom surface and sides, where a cross-section of the core has an approximate rectangular shape, wherein said method comprises:

a) heating the core to soften the polymeric structure so that it deforms slightly when pressure is applied;

b) applying a first geotextile material to the top surface of the core wherein the first geotextile material extends to the edges of the top surface of the core;

c) applying a second geotextile material to the bottom surface and sides of the core wherein the geotextile material extends beyond the sides of the core;

d) applying a molten hot melt adhesive to the first geotextile material;

e) overlapping the second geotextile material over the molten hot melt adhesive to longitudinally encase the structure;

f) applying tension to the geotextile material to cause the geotextile material to tightly wrap and encase the core; and g) heating to cure the hot melt adhesive and to adhere the geotextile material to the softened core polymeric support structure to form the tubing.

The present invention further includes a tubing with improved compression strength for a subsurface water drainage system comprising a core polymeric support structure wrapped longitudinally in a first and second geotextile material, wherein the core polymeric support structure is heated to soften the polymeric structure and wherein the first and second geotextile materials are overlapped and adhered together with a hot melt adhesive and are tensioned to tightly wrap the core, thereby forming the tubing. The tubing is heated to cure the hot melt adhesive and to adhere geotextile material to the softened core polymeric support structure.

DETAILED DESCRIPTION OF A PREFERRED EMBODIMENT OF THE PRESENT INVENTION

Figure 1:
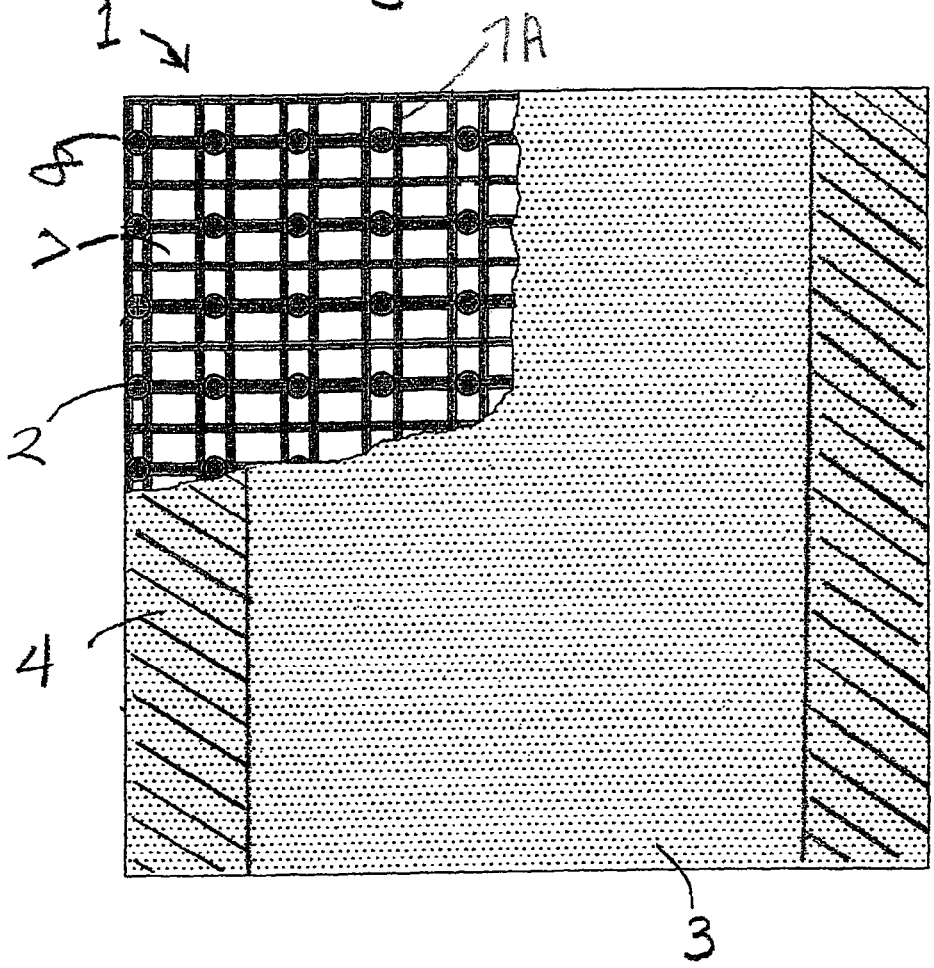
FIG. 1 is a cut-away drawing of the tubing of a preferred embodiment of the present invention.

FIG. 1 is a cut-away drawing of a preferred embodiment of the drainage tubing 1 of the present invention. The core 2 is a polymeric support structure which is wrapped longitudinally with top and bottom geotextile materials 3 and 4. The geotextile material is resistant to biological action and preferably comprises a geotextile material, such as nonwoven spunbonded polypropylene. A preferred geotextile material is marketed as MIRAFI® 140N (a trademark of Tencate Geosynthetics).

Figure 2:
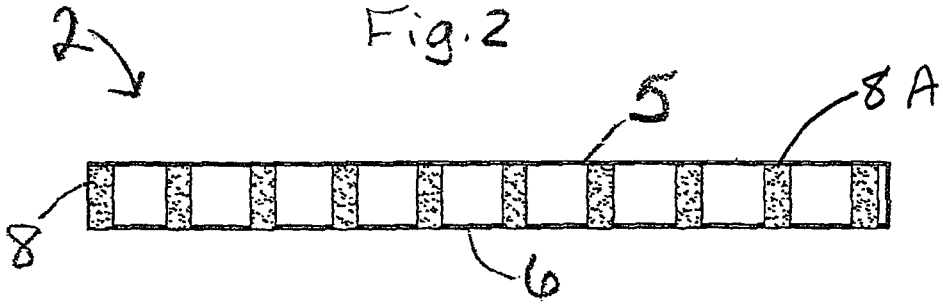
FIG. 2 is a side perspective of the core of the tubing.

FIG. 2 is a side perspective of the core polymeric support structure which is molded as one piece. This material is typically constructed of injection molded polymers such as polyethylene, high density polyethylene (HDPE), or polypropylene. A preferred polymer is high density polyethylene. The core structure has a top surface 5 and a bottom surface 6, which correspond to the top and bottom of the tubing 1. The bottom surface of the core may be an approximately square grid with uprights spaced at about 1.25inch intervals. The grid structure may have HDPE support strips 7A about 0.125 inches wide. The uprights 8 may be about 1.00 inch high. The approximately cylindrical uprights may have about a 0.375 inch outer diameter. The cylindrical uprights may not be solid, but may be hollow and tubular. The rest of the grid may be open space 7 which allows water to flow through the grid into the tube 1 to be carried away by the tube.

Figure 3:
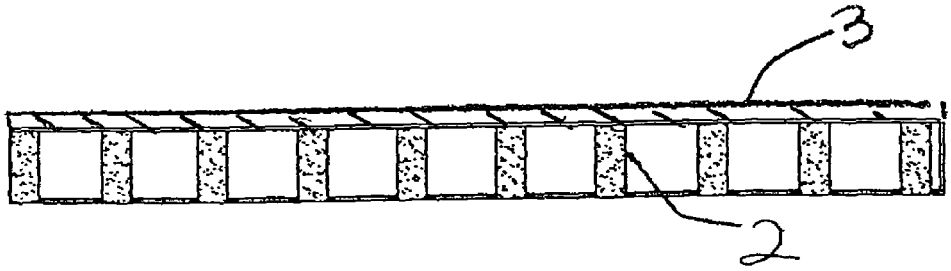
FIG. 3. is a side perspective of the core with the first geotextile material is applied to the top surface of the core.

FIG. 3 is a side perspective of the core polymeric support structure with the first geotextile material 3 applied. The edges of the material approximately extend to the edges of the top surface of the core 2. The core structure is heated before the material is applied, and the polymeric structure is softened by the heat. When the first geotextile material is applied, the softened cylindrical uprights are slightly flattened at the top 8A by the first geotextile material, and the first geotextile material adheres to the uprights.

Figure 4:
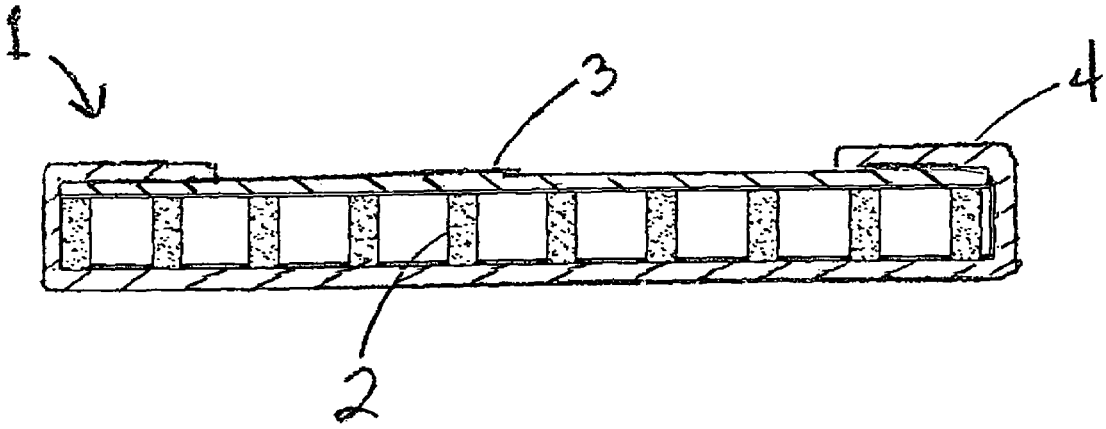
FIG. 4 is a side perspective of a preferred embodiment of the present invention with the first and second geotextile materials applied.

FIG. 4 is a side perspective of a preferred embodiment of the present invention. The second geotextile material 4 is applied to the bottom surface of the core 6 and wrapped around the sides. Hot melt adhesive (not shown) is applied to the first geotextile material 3, and the second geotextile material 4 overlaps the hot melt adhesive and the first geotextile material 3, forming the drainage tubing 1. As the geotextile material is glued in place, tension is applied to the geotextile material, causing the geotextile material to be stretched tightly across the core 2, forming the drainage tubing 1. The tubing 1 is then heated to cure the adhesive, and the geotextile material adheres to the polymeric support core structure.

It is critical that the tubing be manufactured in the order of the steps above. The tubing prepared by the above-disclosed method gives unexpectedly superior properties. It is found that the compression strength of the above tubing is greater than about 10,000 psf. U.S. Pat. No. 4,898,494 disclosed a minimum of 5,000 psf as being acceptable. This unexpected increase in compression strength demonstrates the improvement of the present invention. The tubing of the '494 patent was manufactured by folding the geotextile material over and sewing the edges. This gave a loose covering of the core material. The present invention, because of tensioning the geotextile material when adhering, and because of curing the adhesive, provides a superior product with increased compression strength.

The dimensions of the tubing 1 vary widely, from about 6 to 60 inches wide and from about 1 to 3 inches thick. Preferred dimensions of the tubing 1 are from about 6 to 36 inches wide and about 0.5 to 1.5 inches thick, although the present invention is not limited to those dimensions. The tubing is variable in length, and can be from about 100 to 550 feet.

The invention claimed is:

1. A method of preparing a tubing for a subsurface water drainage system comprising a polymeric support core structure having a top surface and a bottom surface and sides; wherein the bottom surface of the core is a grid with cylindrical uprights having a top; wherein the bottom has support strips 0.125 inches wide and wherein the grid has open space which allows water to flow through it; and wherein a cross-section of the core has an approximate rectangular shape, wherein said method comprises the following steps in the following order:

a) heating the core to soften the polymeric structure so that it deforms slightly when pressure is applied;

b) applying a first geotextile material to the top surface of the core wherein the first geotextile material extends to the edges of the top surface of the core on the top of the uprights; wherein the first geotextile material adheres to the top of the softened uprights;

c) applying a second geotextile material to the bottom surface and sides of the core wherein the geotextile material extends beyond the sides of the core;

d) applying a molten hot melt adhesive to the first geotextile material after it is applied to the core;

e) overlapping the second geotextile material over the molten hot melt adhesive to longitudinally encase the structure;

f) applying tension to the geotextile material to cause the geotextile material to tightly wrap and encase the core; and g) heating to cure the hot melt adhesive and to adhere the geotextile material to the softened core polymeric support structure to provide the tubing, wherein the tubing is internally supported by the core structure;

wherein the compression strength of the tubing is greater than about 5,000 psf.

2. The method of claim 1, wherein the geotextile material comprises nonwoven spunbonded polypropylene.

3. The method of claim 1, wherein the compression strength of the tubing is greater than about 10,000 psf.

* * * * *